US007088933B2

(12) United States Patent
Kitajima

(10) Patent No.: US 7,088,933 B2
(45) Date of Patent: Aug. 8, 2006

(54) IMAGE FORMING APPARATUS WITH CONTROL OF TRANSFER CHARGE

(75) Inventor: Kenichiro Kitajima, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 153 days.

(21) Appl. No.: 10/860,156

(22) Filed: Jun. 4, 2004

(65) Prior Publication Data

US 2004/0253015 A1 Dec. 16, 2004

(30) Foreign Application Priority Data

Jun. 12, 2003 (JP) ..... 2003-168155

(51) Int. Cl.
*G03G 15/16* (2006.01)

(52) U.S. Cl. ..... 399/66

(58) Field of Classification Search ..... 399/66, 399/314, 313, 44
See application file for complete search history.

(56) References Cited

U.S. PATENT DOCUMENTS 5,291,256 A 3/1994 Kitajima et al. ..... 355/290
5,903,798 A * 5/1999 Yokogawa et al. ..... 399/66
6,223,004 B1 * 4/2001 Kodama ..... 399/66

FOREIGN PATENT DOCUMENTS

JP 8-194389 7/1996

* cited by examiner

*Primary Examiner*—David M. Gray
*Assistant Examiner*—Ruth N. LaBombard
(74) *Attorney, Agent, or Firm*—Fitzpatrick, Cella, Harper & Scinto

(57) ABSTRACT

An electrostatic latent image transferring apparatus applies a transferring bias to a transfer member in a transferring portion, wherein a transferring bias value is determined on the basis of a first detection result detected when the surface of the image bearing member which has passed a portion opposed to the developer carrying member when the developing bias is not applied passes the transferring portion, and a second detection result detected when the surface of the image bearing member which has passed the portion opposed to the developer carrying member when the transferring bias is applied passes the transferring portion.

8 Claims, 14 Drawing Sheets

E-V CHARACTERISTIC DIFFERENCE (ORGANIC PHOTOCONDUCTOR VERSUS AMORPHOUS PHOTOCONDUCTOR)

| FIG. 12A |
| --- |
| FIG. 12B |

IMAGE FORMING APPARATUS WITH CONTROL OF TRANSFER CHARGE

BACKGROUND OF THE INVENTION

1. Field of the Invention

This invention generally relates to an image forming apparatus such as a copying machine, a printer or a facsimile apparatus for effecting image forming by an electrophotographic process or the like, and more particularly to an image forming apparatus in which a visible image (toner image) developed on an image bearing member by an electrophotographic process or the like is transferred to a transfer medium such as an intermediate transfer member.

2. Related Background Art

Heretofore, for example, in an image forming apparatus for forming an image on an image bearing member by an electrophotographic process, in order to eliminate the influence of an environmental change or a fluctuation with time to thereby keep the quality of image stable, process control such as exposure amount adjustment and potential control has been effected at electrostatic latent image forming and developing steps, etc.

Also, recently, from the advantage that the use of such an intermediate transfer member as shown in FIG. 1 of the accompanying drawings leads to the securability of transferability to various recording materials, instead of being directly transferred from an image bearing member to a recording material, there have been supplied in the market many image forming apparatuses using an intermediate transfer member. Such image forming apparatus using the intermediate transfer member have been proposed with the view of obtaining full-color image forming free of color misregister.

Briefly describing such an image forming apparatus, the image forming apparatus is provided with a photosensitive drum 1 as an image bearing member driven in the direction of arrow at a predetermined peripheral speed, and around the photosensitive drum 1, there are disposed a corona charger 2 as primary charging means, first developing means 7, i.e., a black developing device BK which is a fixed developing apparatus, second developing means 8 which is a rotary developing apparatus carrying a magenta developing device M, a yellow developing device Y and a cyan developing device C thereon, an intermediate transfer member 9 and cleaning means 11.

The photosensitive drum 1 is first uniformly charged by the corona charger 2, and a light image of a predetermined color is scanned thereon by image exposing means 5 such as a laser beam exposing apparatus, whereby electrostatic latent image forming is effected.

A latent image formed on the photosensitive drum 1 is visualized into a toner image by one of the developing devices of the first developing means 7 and the second developing means 8.

This visualized toner image on the photosensitive drum 1 is transferred to the intermediate transfer member 9. That is, in this example, the intermediate transfer member 9 which is an intermediate transfer belt movably passed over supporting rollers 9*a*–9*d* is brought into contact with the surface of the photosensitive drum 1 with a predetermined pressure force by a primary transfer roller 15 as primary transferring means at a nip section whereat it is moved substantially at the same speed and in the same direction as the photosensitive drum 1, and a voltage opposite in polarity to the charging polarity of the toner and primarily set in advance is applied to the primary transfer roller 15. Thereby, the toner image on the photosensitive drum 1 is transferred onto the intermediate transfer member 9.

The above-described process is repeated a plurality of times for each color, whereby a full-color image is formed on the intermediate transfer member 9. The full-color image formed on the intermediate transfer member 9 is collectively transferred to a recording material P by a secondary transfer roller 10 as secondary transferring means, whereby a full-color image is formed on the recording material P.

Heretofore, the intermediate transfer member 9 and the primary transfer roller 15, in order to suitably adjust the resistance values thereof, have been of a construction in which an electrically conductive substance such as carbon or a metal oxide is dispersed in an elastic material such as rubber.

Generally it is known in such material that the resistance value thereof fluctuates during manufacture and that the resistance value thereof greatly fluctuates with a change in the ambient environment.

When in such a situation, a primary transferring bias applied to the primary transfer roller 15 through the intermediate transfer member 9 is a constant voltage primarily set in advance as in the prior art, it is generally practiced to effect such control as makes a transfer voltage great and carry out the correction of the environment, for example, in a case where as under a low-temperature and low-humidity environment, the resistance of the intermediate transfer member 9 and the primary transfer roller 15 becomes high.

In order to achieve the optimization of such a transferring high voltage as described above, in the prior art, there has been proposed an adjusting method whereby a non-image portion potential area is formed on the photosensitive drum 1 in a pre-rotation section immediately before image forming so that a preset necessary current may be obtained for each environment, and at the timing whereat this non-image portion potential area has arrived at a position opposed to the primary transfer roller 15, a predetermined current is applied and a current-voltage characteristic is measured so that a necessary transferring current may be obtained, and on the basis of the measurement, a primary transferring high voltage during image forming is corrected. It is the substance described, for example, in Japanese Patent Application Laid-Open No. H8-194389.

However, in the process as described above wherein an image is formed on an image bearing member by a regular developing method by the use of a plurality of developing means, when dark portion potential (VD) and light portion potential (VL) on the image bearing member are controlled for each of the plurality of developing means so as to adjust developing contrast potential and non-image portion contrast potential, even if a voltage value is adjusted relative to the non-image portion potential, the dark portion potential (VD) at which the toner image is formed differs from one color to another and therefore, there has become necessary the correction control of the transferring voltage taking not only a constant voltage value in the non-image portion but also the set value of the dark portion potential (VD) into account, and this control has been complicated.

Also, the inventor has empirically confirmed the presence of the inconvenience that when a full-color image is to be formed on an image bearing member by the use of a plurality of developing means, if image forming is effected by the use of developing means of different developing types, for example, developing means of a magnetic non-contact developing type and developing means of a two-component developing type at a time, influences given to the image bearing member during developing (such as fog, adherence of a carrier and friction by contact given a peripheral speed ratio) differ and therefore, even if the same bias value is applied from a primary transferring high voltage source is applied to regions having received the influences of the respective developing means, there occurs the phenomenon that flowing voltage-current characteristics differ from one another.

Also, the inventor has confirmed that the above-described influences of the difference between the developing means upon the image bearing member are also affected by changes in an electrical characteristic by the environmental fluctuations of developers, the intermediate transfer member and the transfer roller.

SUMMARY OF THE INVENTION

So, it is the object of the present invention to provide an image forming apparatus which can perform a stable transferring operation without being affected by developing means.

A preferred image forming apparatus for achieving the above object has:

charging means for charging an image bearing member;

latent image forming means for exposing the charged image bearing member to light to thereby form an electrostatic latent image thereon;

developing means for applying a developing bias to a developer carrying member carrying a developer thereon to thereby develop the electrostatic latent image;

transferring means for electrostatically transferring the developer image on the image bearing member to a transfer medium in a transferring portion;

the transferring means having a transfer member capable of nipping the transfer medium between it and the image bearing member, and charge supplying means capable of supplying charges to the transfer member; and control means for determining a transfer charge supplying condition to the transfer member during a transferring operation on the basis of the result of detection when the operation of detecting a voltage-current characteristic regarding the transfer member is performed during a non-transferring operation;

wherein the control means determines the transfer charge supplying condition on the basis of:

a first detection result when the detecting operation is performed when the surface of the image bearing member which has passed a portion opposed to the developer carrying member when the developing bias is not applied to the developer carrying member passes the transferring portion; and a second detection result when the detecting operation is performed when the surface of the image bearing member which has passed the portion opposed to the developer carrying, member when the developing bias is applied to the developer carrying member passes the transferring portion.

DESCRIPTION OF THE PREFERRED EMBODIMENTS

Figure 1:
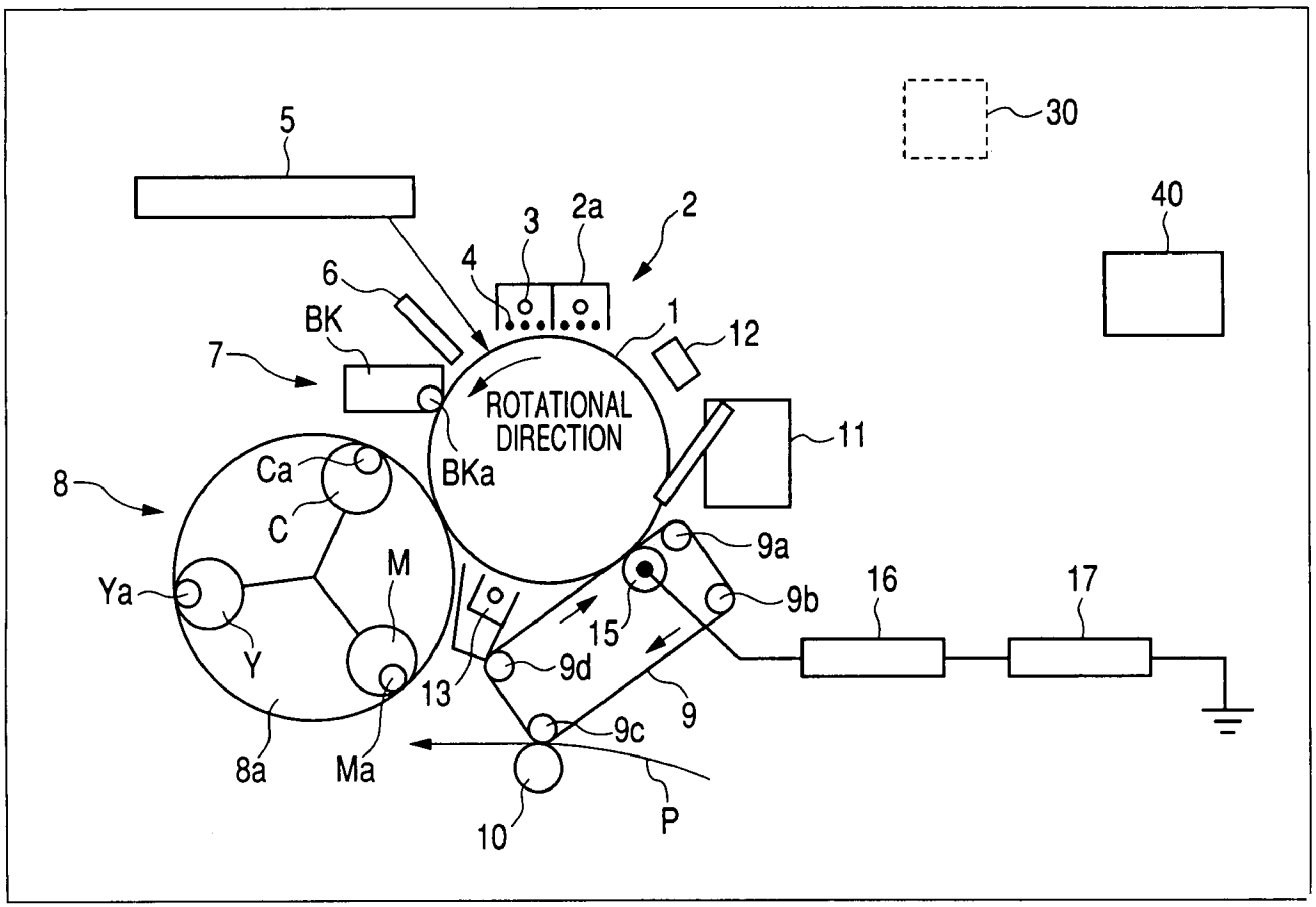
FIG. 1 schematically shows the general construction of an embodiment of an image forming apparatus according to the present invention.

The image forming apparatus according to the present invention will hereinafter be described in greater detail. However, the dimensions, materials, shapes and relative arrangements of constituent parts described in embodiments described below are not intended to restrict this invention thereto unless particularly specified.

First Embodiment

The image forming apparatus of the present invention can be embodied into the full-color image forming apparatus of the electrophotographic type previously described with reference to FIG. 1.

The general construction of the image forming apparatus according to the present embodiment is as described previously. That is, in the present embodiment, the image forming apparatus is provided with a photosensitive drum 1 as an image bearing member driven in the direction of arrow at a predetermined peripheral speed, and around the photosensitive drum 1, there are disposed a corona charger 2 as primary charging means, potential detecting means 6, first developing means 7, i.e., a black developing device BK which is a fixed developing apparatus, second developing means 8 carrying a magenta developing device M, a yellow developing device Y and a cyan developing device C thereon, an ante-transfer charging device 13, an intermediate transfer member 9, cleaning means 11 and optical charge eliminating means 12.

In the present embodiment, the primary charging means 2 can be a corona charger of a scorotron charging type, as described above, where as the present invention is not particularly restricted to the scorotron charging type, but permits the use of also a charging device using a contact charging type such as a magnetic brush charging type.

The corona charger 2 of the scorotron type used in the present embodiment is of a construction well known to those skilled in the art, and discharge wires 3 are extended in a shield 2*a*, and a grid 4 is provided in the opening portion of the shield 2*a* which is opposed to the photosensitive drum 1. While in the present embodiment, two discharge wires 3 are used, the number of the discharge wires may be one or two or more. Also, while in the present embodiment, tungsten wires having a diameter of the order or 40 μm to 100 μm are used as the discharge wires 3, use can also be made of wires of an electrically conductive material (of which the surface layer may be provided with an oxidation preventing layer), or electrically conducting members capable of discharging such as needle electrodes or saw-tooth electrodes.

The voltage applied to the discharge wires 3 is a voltage of 10 KV at maximum and of the order of 1,500 μA as a current amount, and a discharging operation is performed.

In the present embodiment, an electrically conducting member (SUS 304, 430) having a diameter of 50 μm to 200 μm is used as the grid 4, but other electrically conducting member may also be used. There may also be adopted an electrically conducting metal material provided with a particular pattern shape such as a mesh by edging.

By the above-described primary charging means 2, the electrophotographic photosensitive drum 1 is charged to a range of the order of 200 V to 1,000 V.

While in the foregoing description, the image exposing means 5 has been described as a laser beam exposing apparatus using a semiconductor laser beam, exposure can also be effected by the use of an image exposing apparatus utilizing a known light source such as an LED, and the image exposing means is not particularly limited. That is, use can be made of an optical system instrument which can expose the surface of the electrophotographic photosensitive drum 1 to a semiconductor laser beam or LED light in a desired exposure image. In the present embodiment, the photosensitive drum 1 is image-exposed to the non-image portion of an image.

Also, in the present embodiment, the developing means 7 and 8 are of a type which effects regular development. Also, of the plurality of developing means 7 and 8, the first developing means 7 which is the black developing device BK disposed at a location nearest to the charging device 2 is of a magnetic non-contact developing type in which a developer carrying member Bka like a developing sleeve is disposed with a predetermined gap with respect to the photosensitive drum 1 and which is free of a spacing mechanism.

Further describing, the first developing means 7 is magnetic non-contact regular developing means using a magnetic one-component developer, and can develop by the use of, for example, a charged toner opposite in polarity to the charging polarity, i.e., the dark portion potential (VD) polarity, of the photosensitive drum 1. Also, during developing, a developing bias voltage comprising an AC component superimposed on a DC component is applied to the developing sleeve BKa.

At this time, the gap between the developing sleeve BKa of the developing device BK and the photosensitive drum 1 is kept at the order of 100 μm to 300 μm, and a toner layer of the order of 1 to 2 ($mg/cm^2$) is formed on the developing sleeve BKa, and the AC component is applied at a peak-to-peak voltage of the order of 1 to 3 KV and a frequency of the order of 1 to 3 KHz. As the DC component applied to the developing device BK, during non-image forming, 650 V is applied for the prevention of fog, and during image forming, 300 V is applied.

Also, the second developing means 8 which is a rotary developing apparatus is comprised of the magenta developing device M, the yellow developing device Y and the cyan developing device C of three colors, i.e., magenta, yellow and cyan, used during full-color image forming and carried on a rotary supporting member 8*a*. Each developing device is rotated to a position opposed to the photosensitive drum 1, i.e., a developing position, in conformity with the predetermined exposure image by the rotary supporting member 8*a*, and developing is effected.

In the present embodiment, the second developing means 8 for color image forming, unlike the first developing means 7, uses two-component developers including a toner and a carrier, and developing sleeves Ma, Ya and Ca which are the developer carrying form magnetic brushes of the two-component developers on the surfaces thereof, and contact with the photosensitive drum 1 to thereby effect developing.

The construction of the second developing means 8 for effecting magnetic brush contact developing using the two-component developer is conventional developing means well known to those skilled in the art, and does not require any particular condition. Also, in the present embodiment, a developing bias voltage comprising a rectangular wave of the order of 1 to 2 kV and a frequency of the order of 5 to 10 kHz superimposed as an AC component Vpp on a DC component is applied to the developing sleeves Ma, Ya and Ca.

Also, in the present image forming apparatus, as shown in FIG. 1, charges are imparted to the toner image after developed on that area of the image bearing member which has been developed by the use of the magnetic non-contact developing means, by the use of auxiliary charging means 13. In the present embodiment, the auxiliary charging means 13 is a corona charger.

The high voltage condition of this auxiliary charging is designed to discharge a difference current toward the photosensitive drum by applying an AC+DC high voltage, and is designed such that a difference current of the order of 0 to −500 μA toward the photosensitive drum is discharged to a rectangular wave AC high voltage of 8.3 kV and a frequency of 1 KHz as Vpp. The corona charger 13 is the same as the aforedescribed primary charging device 2 in respect of the material of the charging wires thereof or the like.

Primary transferring means 15 successively synthesizes the toner images formed on the photosensitive drum 1 on the intermediate transfer member 9 which is a transfer medium for the respective colors, and collectively secondary-transfers them to a recording material P by secondary transferring means 10.

The primary transferring means 15 for effecting the transfer of the toner images to the intermediate transfer member 9 and the secondary transferring means 10 for effecting the transfer of the toner images to the recording material P are not particularly restricted. In the present embodiment, as the primary transferring means 15, use is made of an electrically conductive elastic roller which is a transfer member formed on a rotatable electrically conductive support member, and a high voltage is applied from high voltage applying means 16 controlled by a constant current or a constant voltage to the electrically conductive support member. Desired charges are imparted to the transfer member by the application of this high voltage, whereby electrostatic transfer is effected. The high voltage from the high voltage applying means 16 suitably is controlled in conformity with the states of the environment, the toner images and the recording material so that the transfer to the intermediate transfer member 9 may be suitably effected. Such control of the charge imparting during the transfer is effected by control means 40.

The optical charge eliminating means 12 applies light by the use of, for example, a known light source. In the present embodiment, the kinds of exposing means and the light source used for the optical charge elimination are not particularly restricted, but yet in the present embodiment, the central wavelength of the image exposing means 5 of the image forming apparatus is 658 nm and the central wavelength of the optical charge eliminating means 12 is 660 nm.

The electrophotographic photosensitive drum 1 used in the present embodiment is formed by a photoconductive layer (photosensitive layer) being provided on a cylindrical electrically conductive backup member, and the photoconductive layer has non-crystalline silicon as its chief component, and is a photoconductor generally called an amorphous photoconductor.

Figure 2:
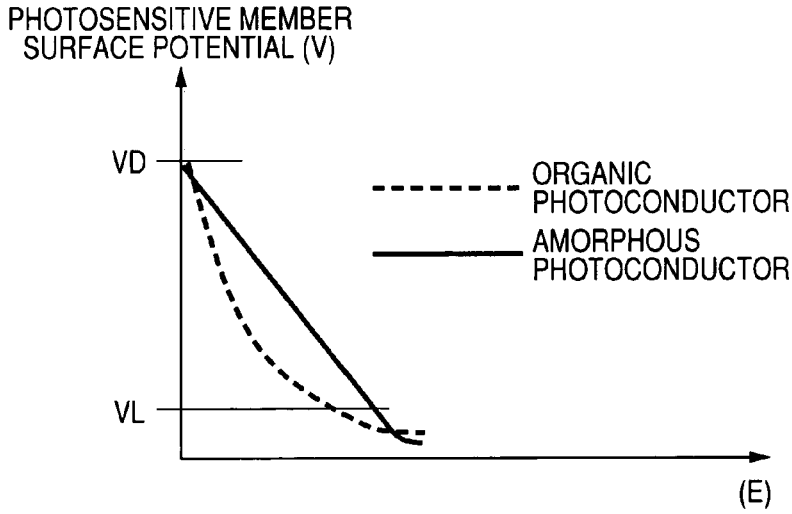
FIG. 2 shows the E-V characteristics of an amorphous silicon photoconductor and an organic photoconductor used as an image bearing member.

It is known that when electrostatic latent image forming is to be effected by the use of the amorphous photoconductor, the light attenuation characteristic by exposure, as shown in FIG. 2, changes more linearly than in the case of an organic photoconductor (OPC) and therefore, there can be obtained an image of a high quality excellent in the reproducibility of isolated dots in electrostatic latent image forming.

Figure 3:
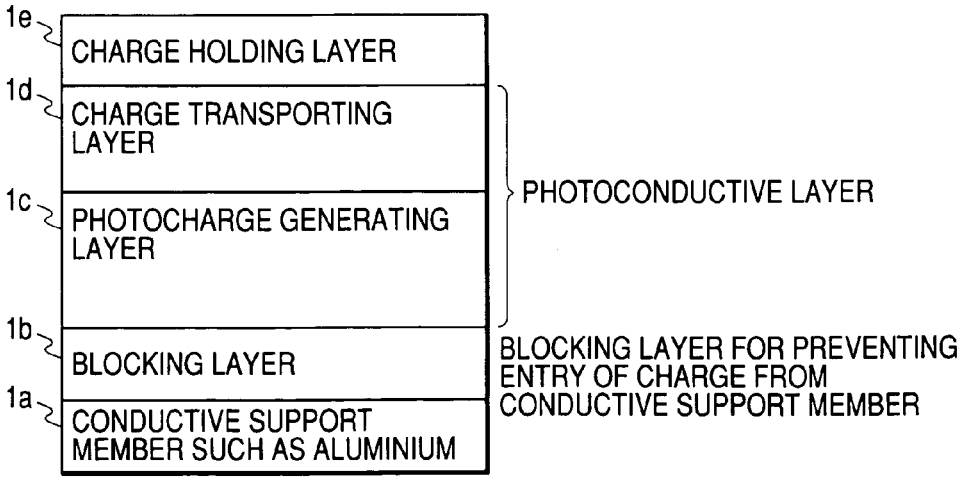
FIG. 3 illustrates the layer construction of an embodiment of the amorphous photoconductor usable in the present invention.

In the present embodiment, the electrophotographic photosensitive member which is the photosensitive drum 1 is of laminated structure in which functions necessary for electrophotographic image forming are separated from one another, and is of a five-layer construction as shown in FIG. 3.

A metallic electrically conductive material such as aluminum may be chiefly mentioned as the material of the electrically conductive support member 1*a*. On the electrically conductive support member 1*a*, as shown in FIG. 3, there are formed a blocking layer 1*b* for preventing the entry of charges from the electrically conductive support member 1*a*, and a photoconductive layer provided with a photocharge generating layer 1*c* in which the generation of a pair of charges by the application of light is effected, and a charge transporting layer 1*d* in which the generated charges can move. Also, as the upper layer of the photoconductive layer, there is provided a charge holding layer 1*e* for holding charges in the outermost layer of the photoconductive layer.

The photoconductive layer may contain, besides silicon as the chief component, such components as hydrogen, oxygen and butane in order to adjust spectral sensitivity, and improve electrical characteristics such as charge ability and residual potential.

Also, in the laminated construction formed on the electrically conductive support member 1*a* and having non-crystalline silicon as the chief component, the blocking layer 1*b* has a film thickness of the order of 3 μm, the photoconductive layer (the photocharge generating layer 1*c* and the charge transporting layer 1*d*) has a film thickness of the order of 30 μm, and the surface charge holding layer 1*e* has a film thickness of the order of 1 μm.

Description will now be made of the control of the primary transferring means forming a feature of the present invention, i.e., the primary transfer roller 15 in the present embodiment.

Figure 4:
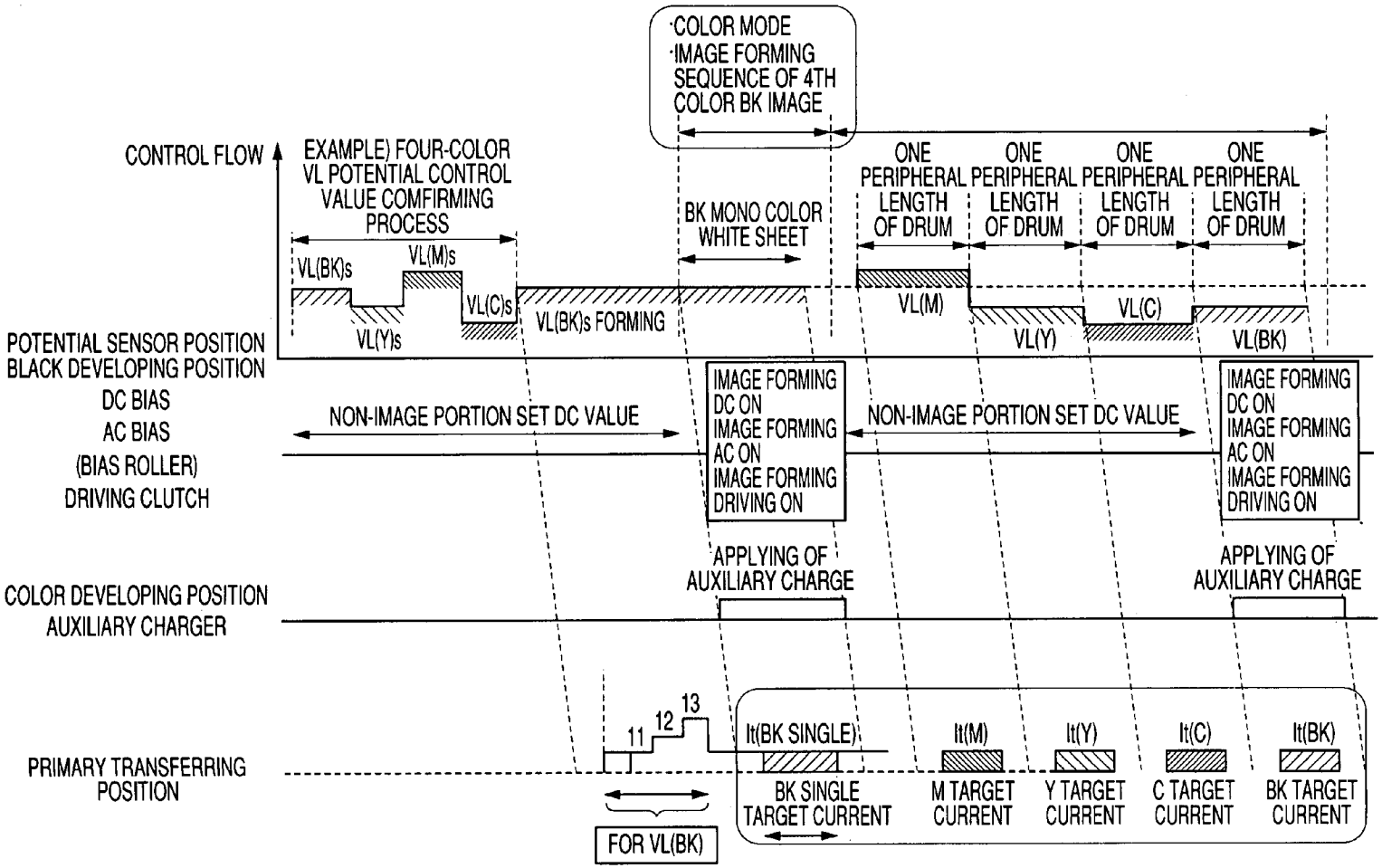
FIG. 4 is a correction control model diagram of primary transferring high voltage control.

The situation in which potential control in the present embodiment has been carried out will hereinafter be described with reference to FIG. 4 with a charge in the potential as a change in the potential with the lapse of time.

As a potential controlling process, under a condition in which the current applied to the discharge wires 3 in the primary charging device 2 is made constant, setting is made to a grid bias condition in which a constant voltage (Vg) is applied to the shield 2*a* and the grid 4 of the charging device 2 at a plurality of stages, and is detected by potential detecting means (potential sensor) 6 and on the basis of the result thereof, target dark portion potential (VD) is obtained.

In the present embodiment, the target dark portion potential (VD) was adjusted to 510 V at the position of the potential sensor 6 so as to be 500 V at the position of the first developing means 7, and be 450 V at the position of the second developing means 8.

Thereafter, in order to obtain non-image portion potential (VL) conforming to each of the developing means 7 and 8, the laser exposure amount is changed by the image exposing means 5. In the present embodiment, four stages of exposure amount are allotted and the E-V characteristic of the photosensitive member is measured.

On the basis of the result of this measurement, the exposure amount of the laser is determined so as to provide non-image portion potential (VL) conforming to the target values of the developing contrast potential and non-image portion contrast potential of the developing means 7 and 8 at the position of the potential sensor 6 with the attenuation amount of the potential at the position of the potential sensor 6 and the positions of the developing means 7 and 8 pre-stored in the image forming apparatus taken into account.

As the next step, the VL potential obtained as the result of the above-described potential control is formed in accordance with the order of the image forming by the developing means 7 and 8. The order of the colors in the present embodiment is magenta M, yellow Y, cyan C and black BK, and accordingly, the black developing device BK is carried at the position of the first developing means in FIG. 1, and the magenta developing device M, the yellow developing device Y and the cyan developing device C are carried at predetermined positions in the rotary supporting member 8*a*.

The VL potential of the first color, i.e., magenta (M) in the present embodiment, is formed and also, the measurement of the VL potential is effected over one round of the photosensitive drum 1 at the timing whereat the VL potential of the first color passes the position of the potential sensor 6. At this time, one round on the photosensitive drum 1 is measured at eight points, and the average value thereof is used as the VL potential for magenta (M), i.e., VL (M).

The reason why re-confirmation is thus done after the control of the VL potential has been carried is that the image bearing member 1 of the image forming apparatus used in the present invention is an amorphous silicon photosensitive drum and the unevenness of the potential corresponding to one round of the photosensitive drum is great as compared with that in the case of OPC or the like, and that it is necessary to improve the accuracy for accurately calculating the correction amount of the primary transferring high voltage to the intermediate transfer member 9 which will be described below.

(1) Method of Calculating the Basic Target Voltage Value and Measurement of the Correction Amount 2

A method of calculating the correction amounts 1 and 2 used in the transferring high voltage control of the present invention will now be described with reference to the sequence model diagram of FIG. 4, the basic flow chart of this control shown in FIG. 5 and flow charts shown in FIGS. 6 to 11.

Figure 5:
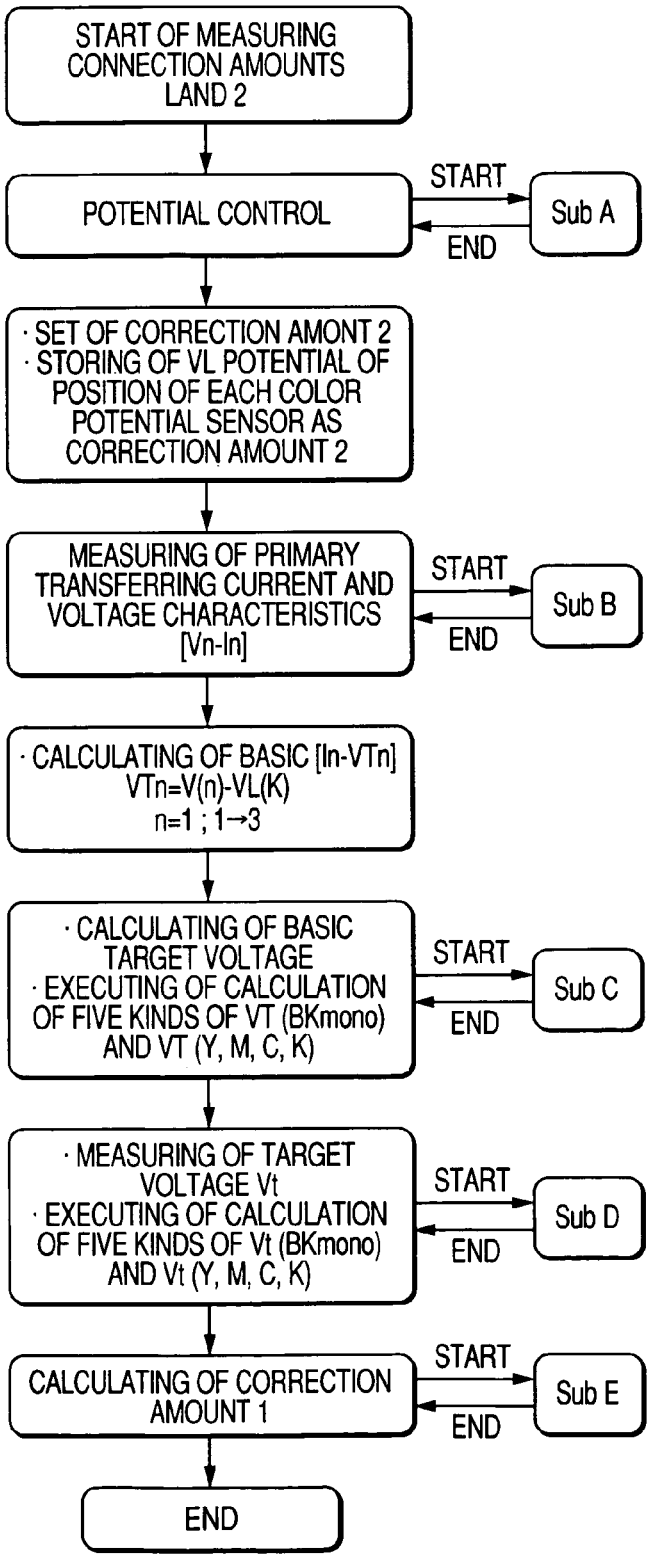
FIG. 5 is a basic control flow chart for calculating the correction amounts 1 and 2 of the primary transferring high voltage control.
Figure 6:
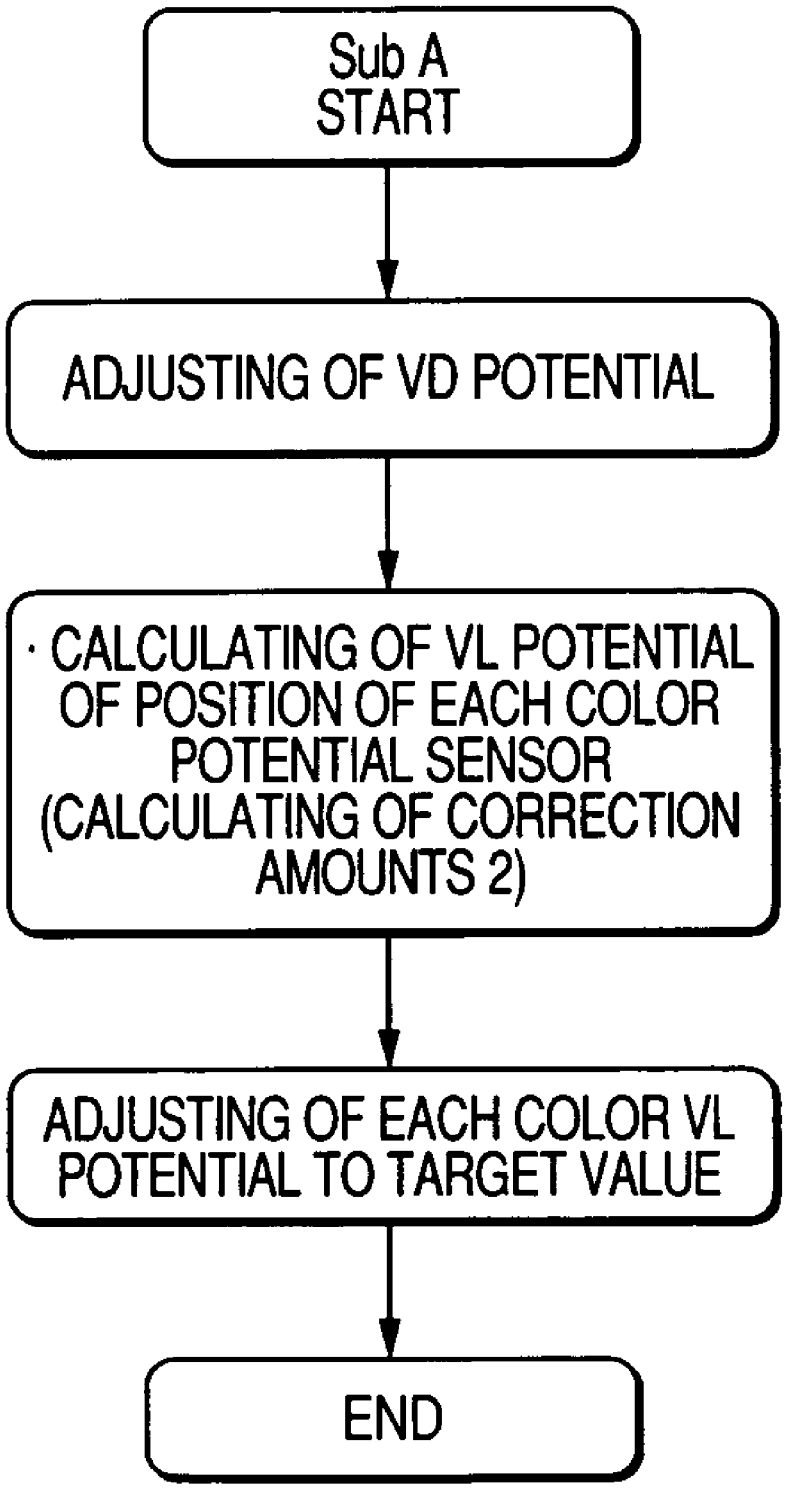
FIG. 6 is a flow chart of potential control (measurement of the correction amount 2) at Sub A in FIG. 5.

When as shown in FIG. 5, the correction control of the primary transfer is started, potential control (FIG. 6) is first executed and the VL potential at the position of the potential sensor of each color which is the correction amount 2 is found.

Next, predetermined potential, in the present embodiment, VL potential for black BK, is formed.

At this time, the black developing device BK has a DC high voltage 650 V applied thereto with the driving thereof rendered OFF so that the developer may not move to the photosensitive drum 1. The bias applied at this time is a bias which does not perform a developing operation.

Figure 7:
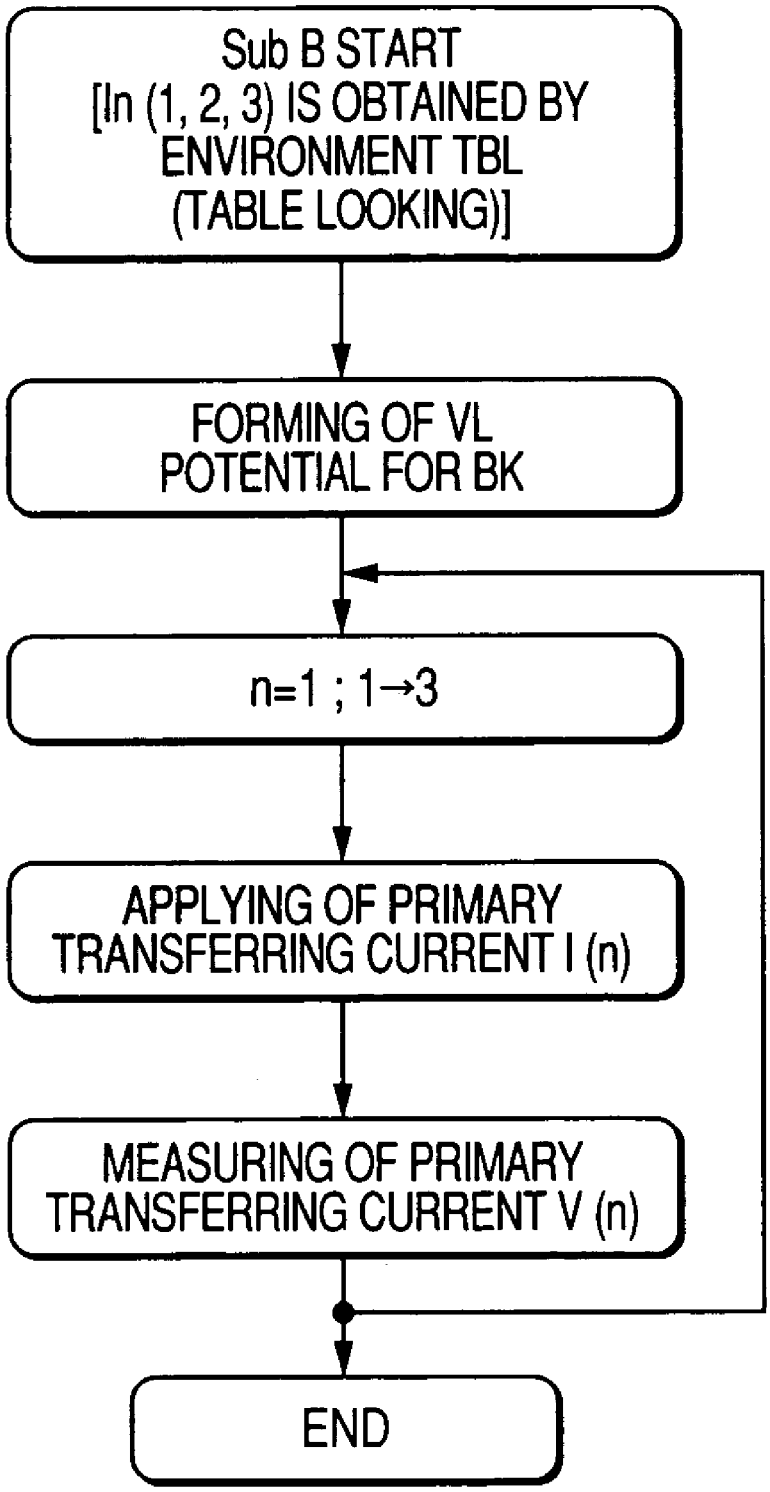
FIG. 7 is a current-voltage measurement flow chart at Sub B in FIG. 5.

At the timing whereat black non-image portion potential VL(K) has arrived at a primary transferring area, a primary current In of n stages (n being an integer) is applied as shown in FIG. 7, and under each condition, a voltage Vn corresponding to one round of the photosensitive drum 1 is measured by the use of a voltage detection circuit provided in a primary transferring high voltage circuit, not shown. In the present embodiment, there is shown a case where n=3.

The current-voltage characteristic of the primary transfer obtained at this time is stored as "Vn-In." On the basis of this result, VL(K) used for measurement is subtracted from the aforementioned potential Vn (VTn=Vn−VL(K)) to thereby calculate "basic VTn-In characteristic."

Figure 8:
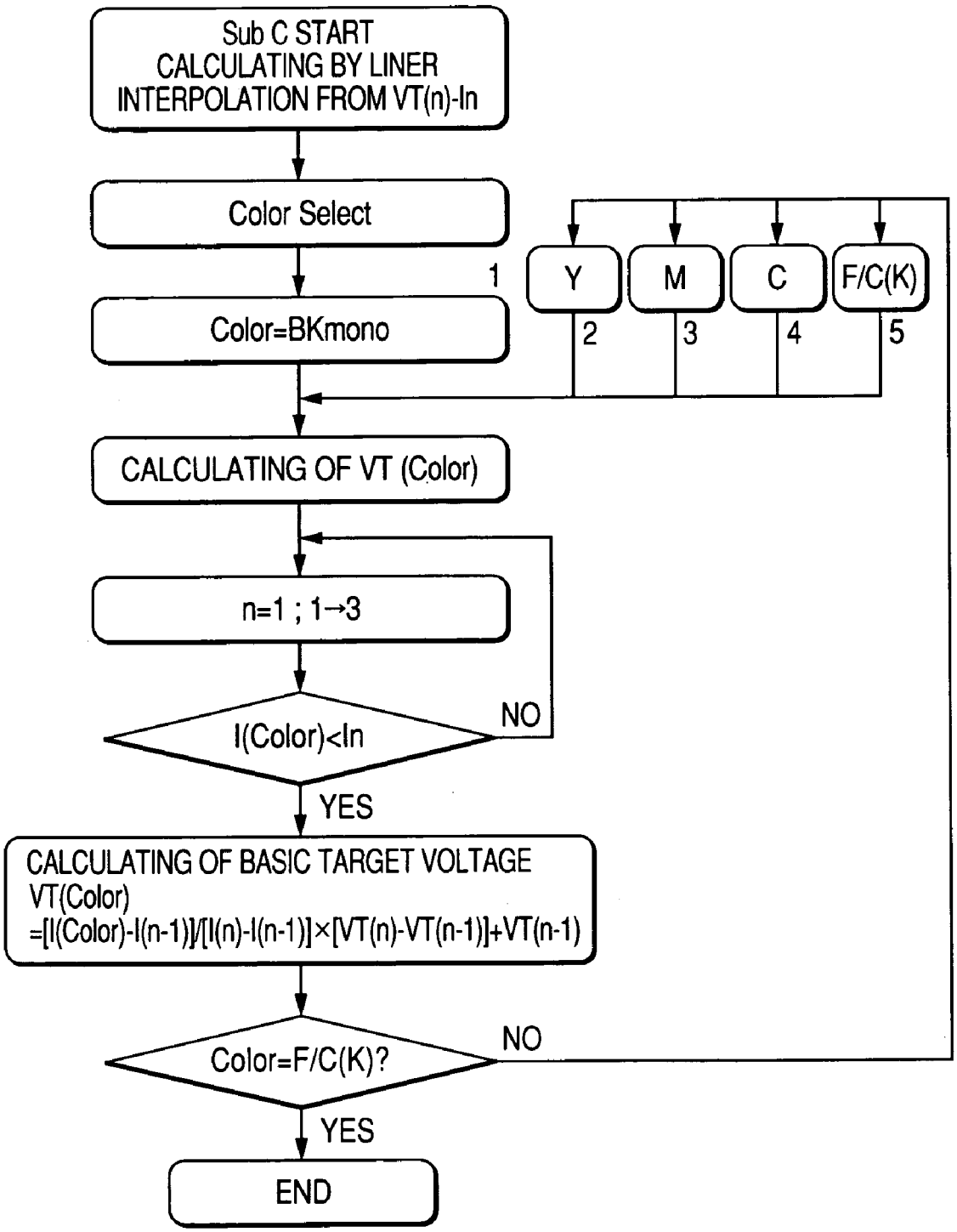
FIG. 8 is a basic target voltage calculation flow chart at Sub C in FIG. 5.

From this result, as shown in FIG. 8 (the portion thereof for the calculation of the basic target voltage), a voltage value for which five kinds of target current values of the respective colors Bk mono, M, Y, C and K are obtained is calculated by the utilization of the previously obtained basic VTn-In characteristic (a voltage for which the target current value is obtained is found by liner interpolation by the utilization of the two voltage-current data of the basic VTn-In characteristic about the target current value), and is stored as a basic target voltage value VT (BK mono, M, Y, C and K) in the image forming apparatus.

Here, the reason why the value detected at the position of the potential sensor 6 is used-that the potential dark attenuation amount from the sensor position to the primary transferring position is 40 V to 50 V in the areas of the dark portion potential VD and light portion potential VL in the image forming apparatus according to the present embodiment and there is only a difference of the order of 10 V, and therefore calculation is effected by the use of the potential at the position of the sensor 6.

The reason why the dark attenuation is not considered here is that the dark attenuation amounts at the sensor position and at the primary transferring position do not have a great difference therebetween even if there is more or less difference in VL potential, and a suitable voltage amount is only subjected to offset correction, and the presence or absence of the reflection of the dark attenuation correction amount upon control poses no problem in carrying out the correction control of the present invention.

(2) Method of Calculating the Correction Amount 1

Description will now be made of a method of calculating the correction amount 1.

Figure 9:
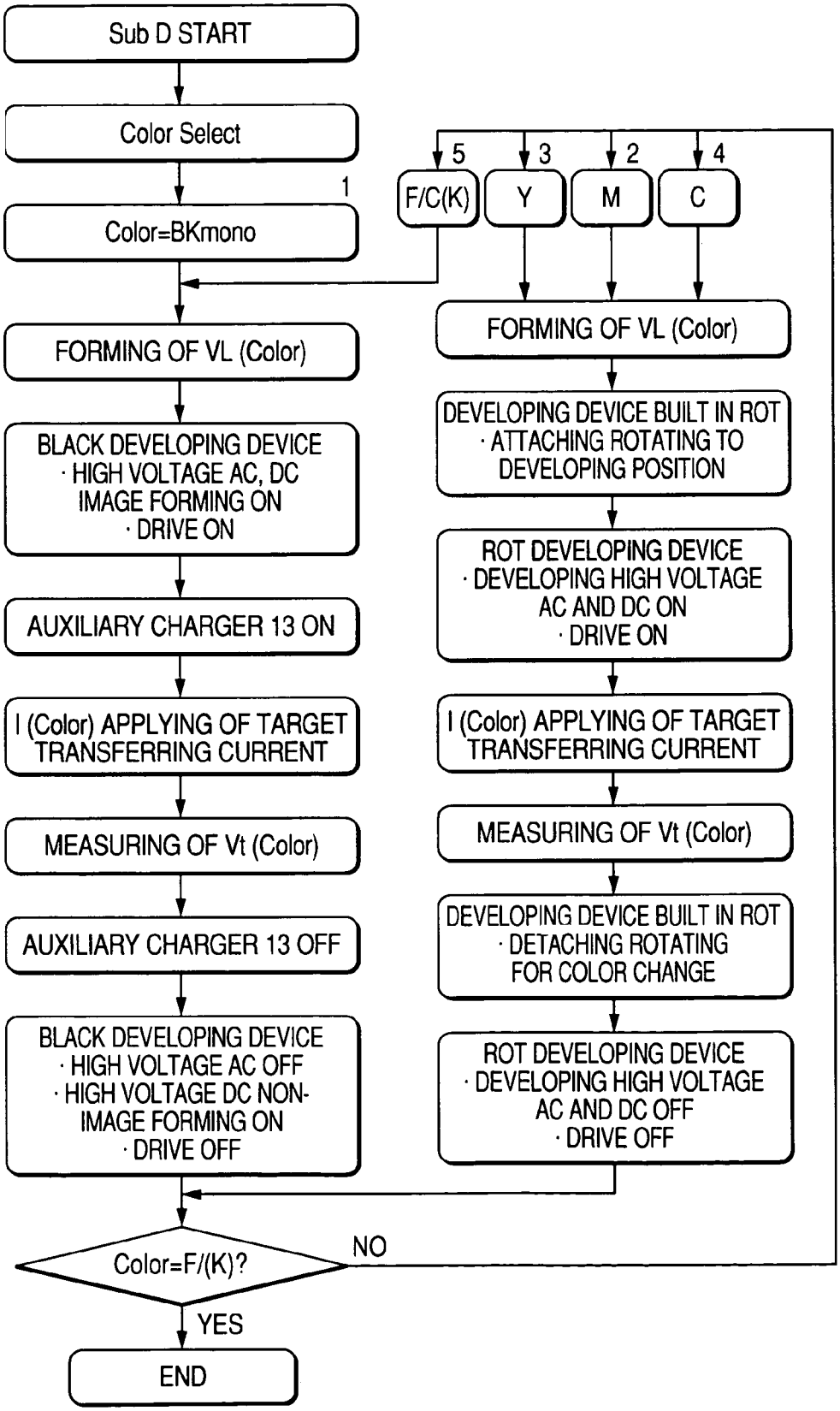
FIG. 9 is a target voltage measurement flow chart at Sub D in FIG. 5.

At first, the same condition as the BK mono-color image forming condition is formed in accordance with the flow chart of FIG. 9.

As regards the latent image condition at this time, blank for BK, i.e., non-image portion forming potential=VL(K) is formed. As during image forming, a high voltage for auxiliary charging is applied by the auxiliary charging means 13 to a VL potential area on the photosensitive drum 1 which has passed a region opposed to the potential sensor 6 and a region on the photosensitive drum 1 to which a predetermined developing high voltage has been applied by the black developing device BK of the first developing means 7.

At the timing whereat that area of the photosensitive drum 1 which has passed this black developing device BK arrives at a primary transferring area, a constant current which is a target BK mono-color current I (BK mono) is applied to the primary transfer roller 15.

A voltage produced in that state is measured for one round of the photosensitive drum 1 by voltage detecting means 17, and the average value thereof is defined as Vt (BK mono).

Next, image forming for blank during full-color (F/C) image forming is continually effected and as shown in FIG. 9, the developing device of each color is located at a developing position by the same procedure as that during the aforedescribed BK mono-color image forming, whereafter a target primary transferring current for each color is applied while a developing bias during the developing operation is applied, and voltages Vt(M), Vt(Y), Vt(C) and Vt(K) for the respective colors are obtained.

Figure 10:
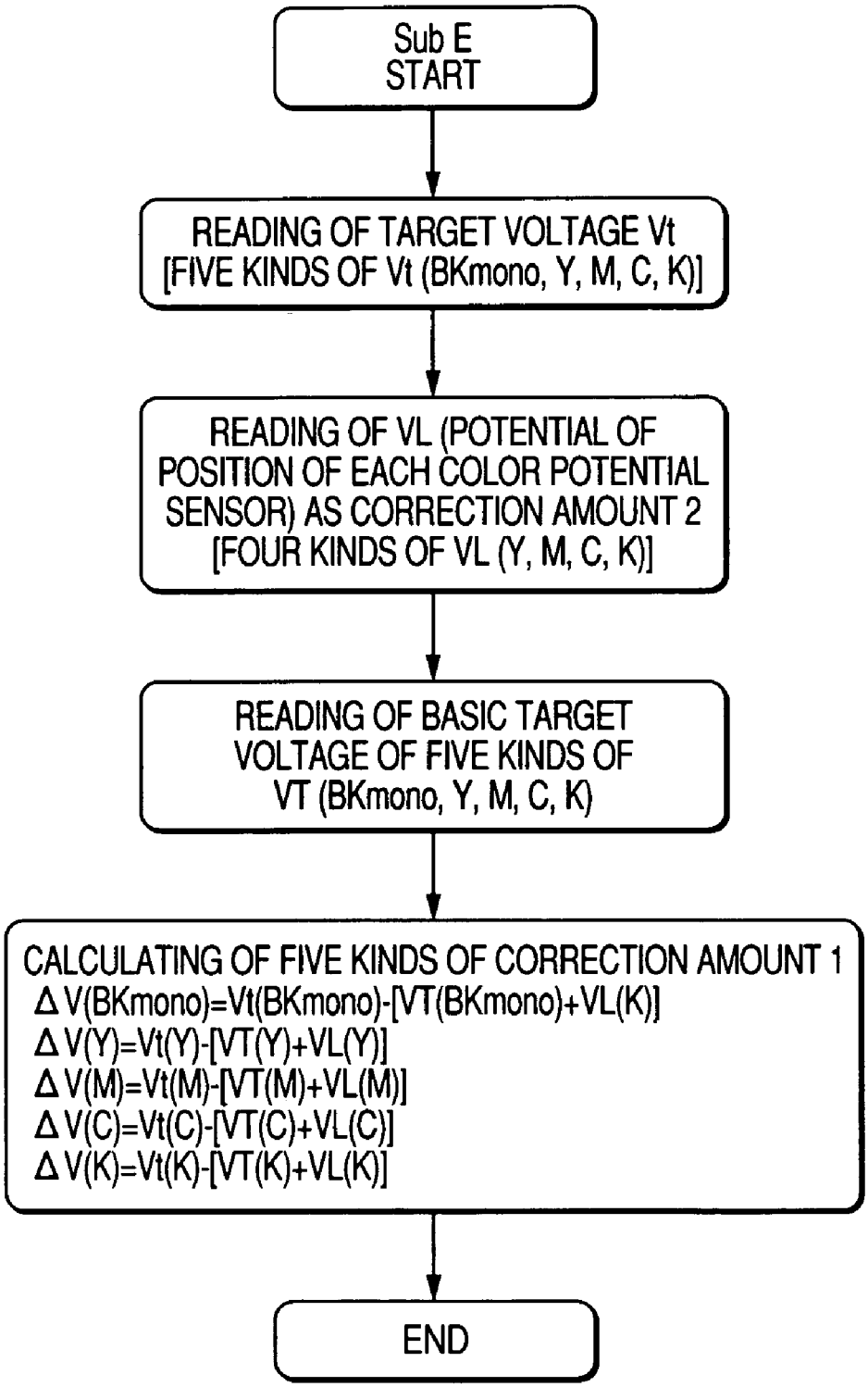
FIG. 10 is a measurement flow chart of the correction amount 2 at Sub E in FIG. 5.

A correction amount 1ΔV is calculated on the basis of the voltage values of Vt detected under the aforedescribed image forming condition, the aforedescribed basic target voltage VT and the VL potential for each color. FIG. 10 shows the calculation flow thereof.

Here, showing the calculation of the correction amount 1 for BK mono-color by an example, $$\Delta V(BK\ \text{mono})=Vt(BK\ \text{mono})-(VT(BK\ \text{mono})+VL(K)),$$

and as shown in FIG. 10, five kinds of correction amounts 1 are calculated.

The reason why the primary transferring high voltage for the black developing device BK is set to two kinds, i.e., that for BK mono-color and that for full-color (F/C), is that during full-color developing, the first developing means 7 which is the black developing device BK is for the last color, and the hysteresis of the second developing means 8 comprising the developing devices for the first to third colors is residual on the photosensitive drum 1 or the intermediate transfer member 9 and therefore, it is necessary to use the correction amount 1 taking the influence of the states of the developing devices Y, M and C into account, and when the black developing device BK is singly used, the correction amount 1 therefore is not affected by the developing devices Y, M and C and thus, the value of the correction amount 1 differs.

(3) Primary Transfer Control Flow during Image Forming

Figure 11:
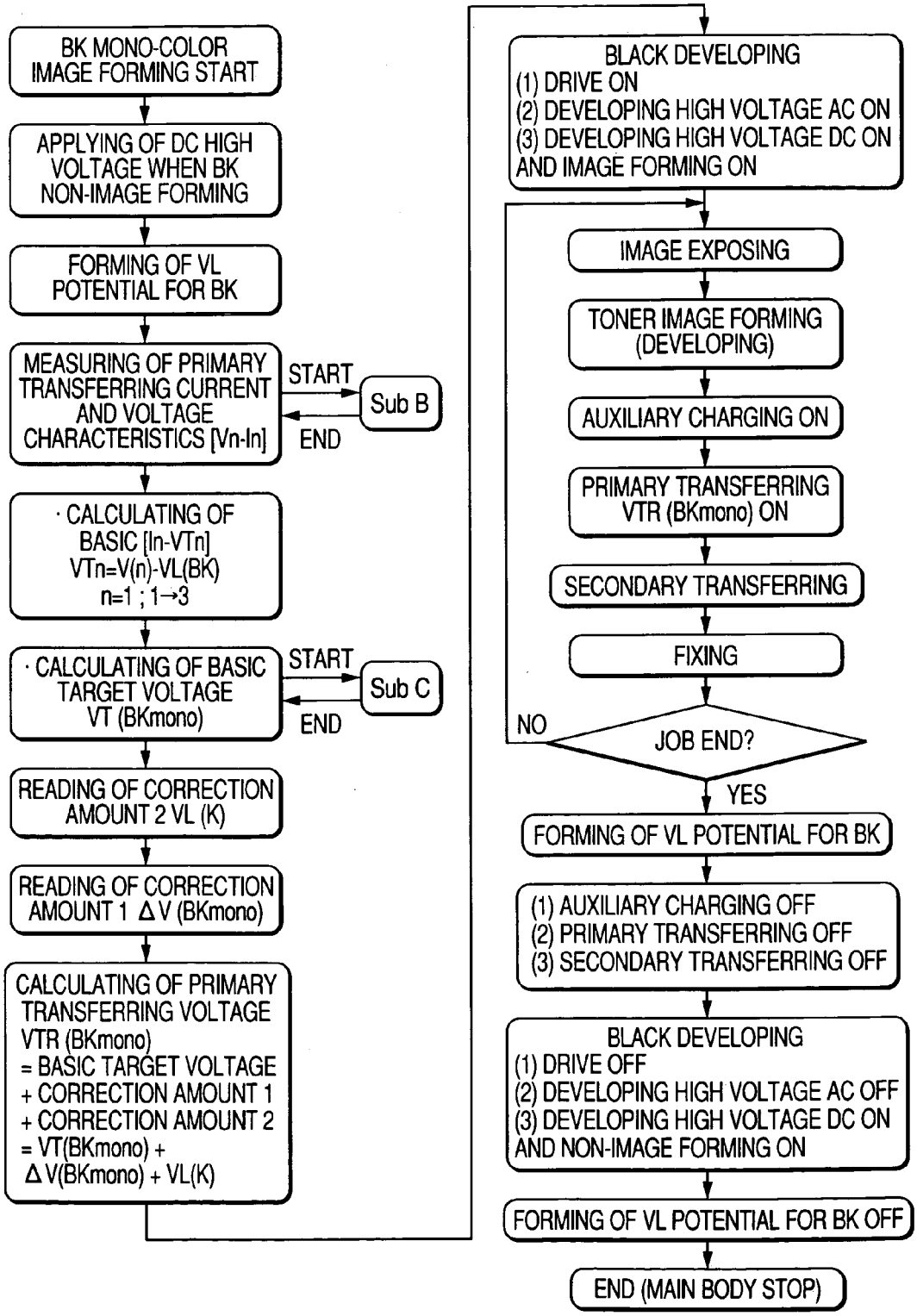
FIG. 11 is a control flow chart during BK mono-color image forming.
Figures 12, 12A:
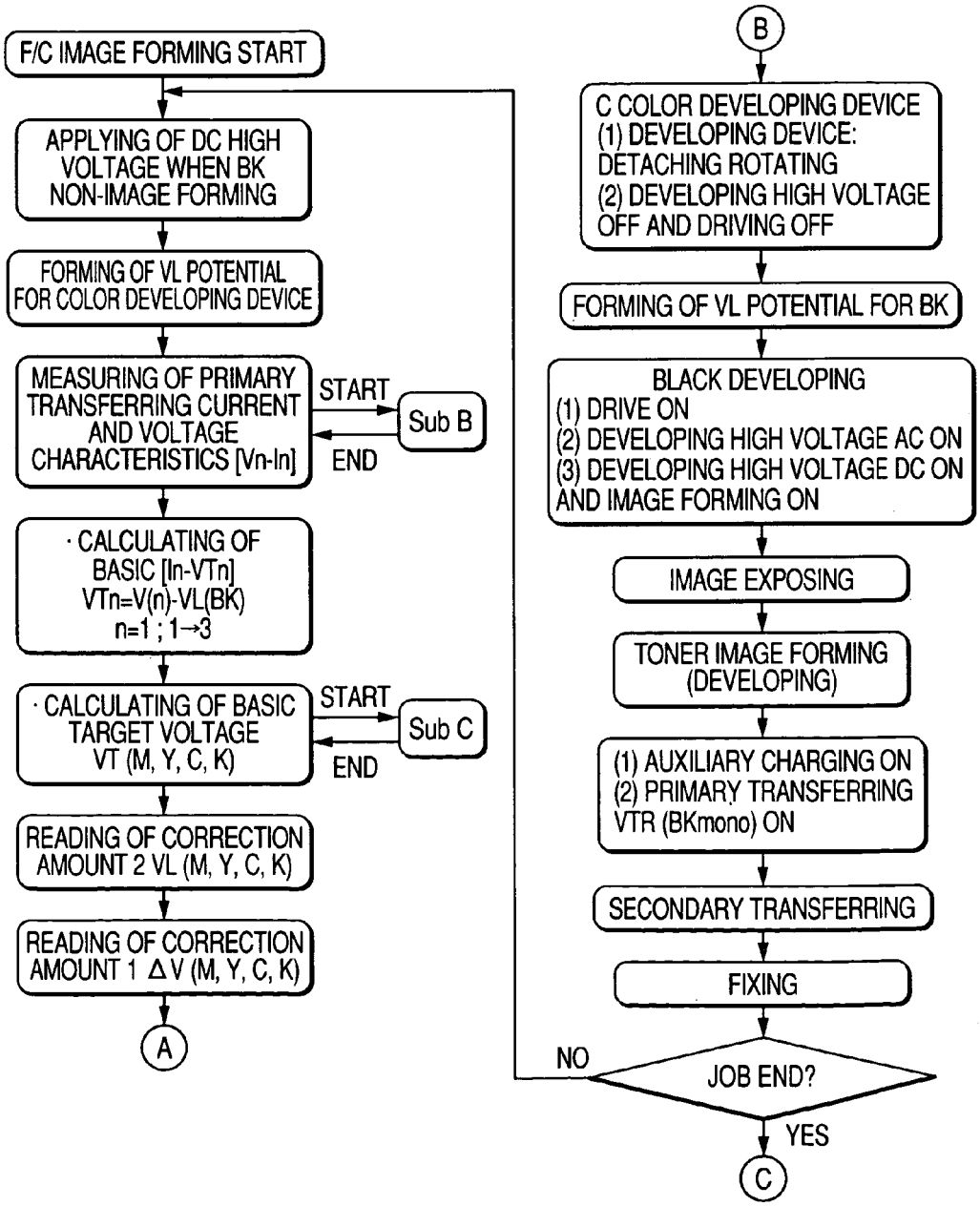
FIG. 12 is comprised of FIG. 12A and FIG. 12B, showing control flowcharts during full-color image forming.
Figure 12B:
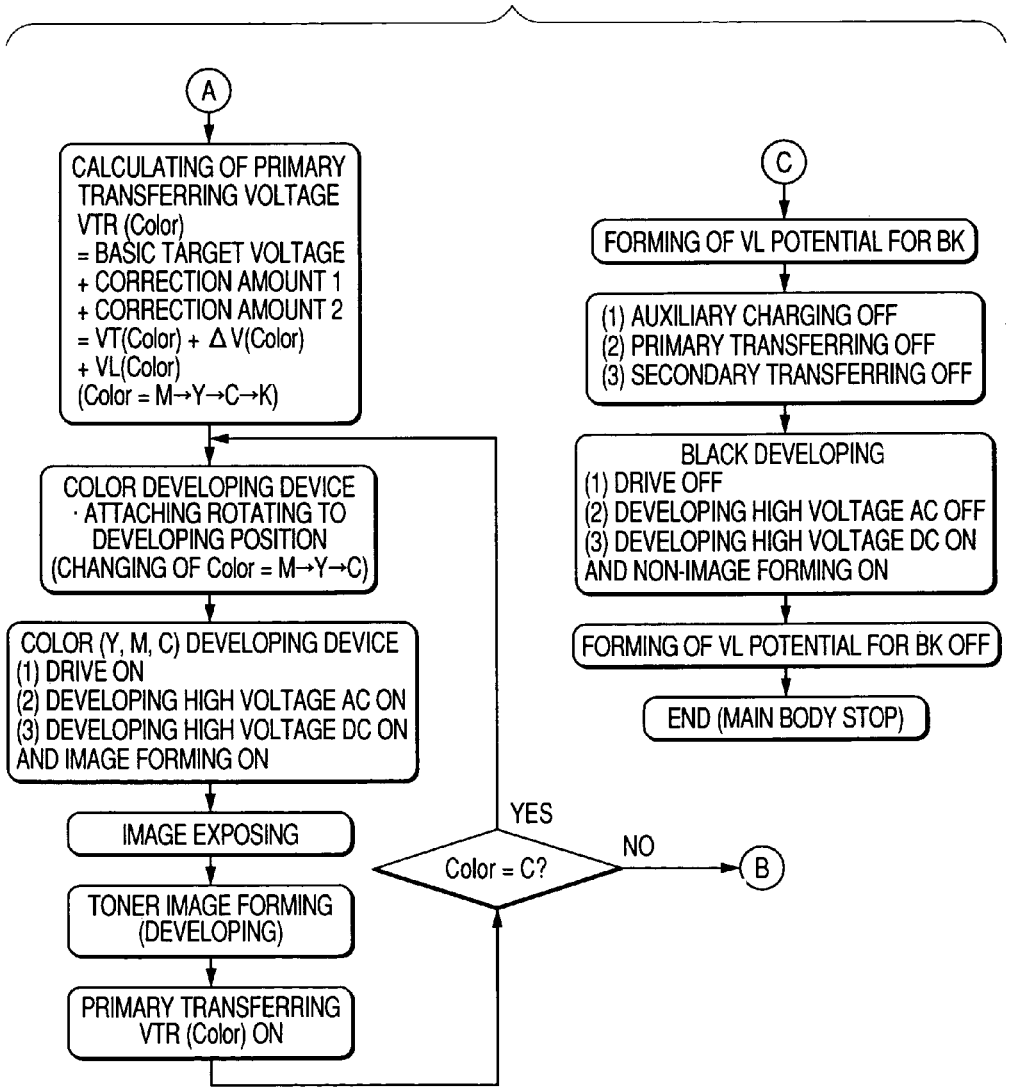

FIG. 11 shows an image forming flow during BK mono-color, and FIGS. 12A and 12B show control flows during F/C image forming.

The case of a BK mono-color mode will first be described with reference to FIG. 11.

At a point of time whereat the driving of the main body has been started and the photosensitive drum 1 and the intermediate transfer member 9 have assumed their steady rotation, the charging by the primary charging device 2 is started, and the image exposure by the exposing means 5 is started in order to form the non-image portion VL potential (VL(K)) of the BK image.

At this time, DC 650 V for non-image forming is applied as the high voltage of the black developing device BK, and AC high voltage driving is not effected.

At a state whereat under such situation, the VL potential area on the photosensitive drum 1 which has passed the aforementioned region opposed to the potential sensor 6 has arrived at the primary transferring area, the primary transferring current is changed by n stages as when the aforementioned correction amounts were calculated, and the then voltage value Vn is measured.

From the result of this, the relation of "basic VTn-In characteristic" is calculated by the use of a value obtained by subtracting VL(K) used for the measurement from the voltage Vn.

By the use of this basic VTn-In characteristic, VT (BK mono) is calculated with a transferring voltage at which the target primary transferring current is obtained as a basic target voltage.

While in the construction of the present embodiment, the mode is an image forming BK mono-color mode, the four basic target voltages VT(M), VT(Y), VT(C) and VT(K) for full-color image forming are also calculated at a time and are stored in a storing portion.

The purpose of this is for coping with also a case where image forming is continuously effected without being interrupted when the image forming apparatus has received a full-color image output command during the outputting of a BK image.

The aforementioned correction amount 1 and correction amount 2 are added to this basic target voltage VT (BK mono) to thereby calculate the primary transferring voltage VTR (BK mono) during image forming. That is, it is calculated as $$VTR(BK\ \text{mono})=\text{basic target voltage}+\text{correction amount 1}+\text{correction amount 2}=VT(BK\ \text{mono})+\Delta V(BK\ \text{mono})+VL(K).$$

Here, the basic target voltage is a voltage value conforming to the fluctuation of the resistance of the primary transfer material varied by the environment or the like.

Also, the correction amount 1 is a correction amount for correcting impedance differing from the condition under which the aforementioned developing high voltage is not applied when the primary transferring high voltage by a slight amount of substance (an amount which is not a level appearing in the image by the toner and the carrier) adhering to the developer on the drum which differs from one developing device to another is applied to the blank area (non-image area) during the actual image forming.

Further, the correction amount 2 is VL potential for each color, and is for correcting the primary transferring high voltage conforming to the latent image contrast condition for each color by being added to the "basic VTn-In characteristic" measured without being affected by the amount of adherence of the developer onto the drum differing inherently to the developing device.

By thus storing the correction amounts 1 and 2, it becomes possible to measure only the current-voltage characteristic changed by the fluctuation of the resistance of the primary transfer material at the start of image forming to thereby obtain a target transferring voltage.

Thereafter, the driving of the black developing device BK, the developing AC high voltage and the DC high voltage are changed to the developing condition, and at the timing whereat that region on the photosensitive drum 1 subjected to image exposure has arrived at the primary transferring area, the aforementioned VTR (BK mono) is applied and the primary transferring operation is performed, and then secondary transfer and fixing are performed, thus completing image forming.

Description will now be made of the full-color image forming time.

The VL potential used during the measurement of the basic In-Vn characteristic in the image forming apparatus according to the present embodiment, unlike during the aforedescribed BK mono-color, is selected to VL(M) for the first color during full-color (F/C) image forming.

The situation of black developing at this time is the same as that in the case of the afore-described black mono-color, and only the DC high voltage during the stoppage of driving and non-image forming is applied.

Also, at this time, the developing device M for magenta (M) fixed to the rotary supporting member 8*a* is not moved to the developing member 8*a* is not moved to the developing position, but remains in HP (home position).

As regards In for performing the basic Vn-In characteristic, the current In to be applied is set so that as to be capable of measuring the area of the target current value of each developing device stored for each environmental condition in a storing portion, not shown, in the image forming apparatus.

Here, for the simplification of the description, the target current values for the three colors, i.e., magenta M, yellow Y and cyan C, are defined as 70 μA, and the target current value for black BK is defined as 50 μA.

At the VL section of the aforementioned pre-charging, three stages of constant currents of 20 μA, 60 μA and 100 μA are applied as In (1, 2 and 3), and at each section corresponding to one round of the transfer roller, a voltage value detected during the application of the constant currents at a time interval necessary for the changeover of the high voltage is measured by the use of voltage detecting means 17.

The basic target voltage VT at which target current values for magenta M, yellow Y, cyan C, black BK and BK mono-color are obtained from the current-voltage characteristic obtained at this time and measured at the VL potential for magenta (M) which is the first color is calculated by the same procedure as in the case of the black mono-color.

A value obtained by adding the correction value 1 and correction value 2 obtained during the execution of the aforementioned potential control to the voltage value for each color obtained at the pre-charging VL section before this image forming is applied during the transfer of the toner images to the intermediate transfer member 9. Describing correction calculation with yellow Y as the second color taken as an example, $$VTR(Y)=Vt(Y)+\text{correction amount 1}(\Delta V(Y))+\text{correction amount 2}(VL(Y)).$$

By carrying out such control of the primary transferring high voltage, it becomes possible to form a preferred image.

Second Embodiment

In describing a second embodiment, the construction of the image forming apparatus need not be described because it is the same as that of the first embodiment.

In the first embodiment, description has been made of a method of forming VL potential differing for each developing device constituting the developing means 7 and 8 on the photosensitive drum 1 which is an image bearing member, applying a predetermined bias not to each developing device located at the position opposed to the photosensitive drum 1, but to the primary transfer roller 15 in the area of the photosensitive drum 1 with which the developing device is disposed in opposed relationship, calculating the Vn-In characteristic, storing the difference from the VL potential detected for each color at the position of the potential sensor 6 as basic VTn-In, and calculating the basic target voltage from this relation.

However, the charging characteristics of the toner and the carrier used in each developing device is also changed by the environment and therefore it is difficult for the correction amount 1 under a predetermined condition to follow the fluctuation of the ambient environment and maintain proper transferability. Thus, it is desirable to effect the control of renewing the correction amount 1 at suitable timing.

By effecting such control, it becomes possible to adjust the correction amount 1 at any suitable time for the influence of the fluctuation of the resistance of the intermediate transfer member 9 and the primary transfer roller 15 in conformity with the fluctuation of the environment and the fluctuations of the developing devices.

This second embodiment is characterized by the provision of means for re-measuring the correction amount 1 when it is detected by an environment sensor 30 (FIG. 1) provided in the image forming apparatus that the set value of the target current value has changed over from the environment under which the correction amount calculated at the last time was calculated in accordance with the table (TBL) of the target current values for the respective colors obtained in advance by environment.

As an example in which the adjustment of the correction amount 1 is necessary as described above, in the present embodiment, the current-voltage characteristic has been measured with respect to the non-image portion potential of that region of the photosensitive drum 1 subjected to the influence of the developing means of the magnetic non-contact type using a one-component magnetic developer which is the black developing device BK constituting the first developing means 7, and that region of the photosensitive drum 1 subjected to the influence of the developing means of the contact type using two-component magnetic developers which are the magenta developing device M, the yellow developing device Y and the cyan developing device C constituting the second developing means 8.

Figure 13:
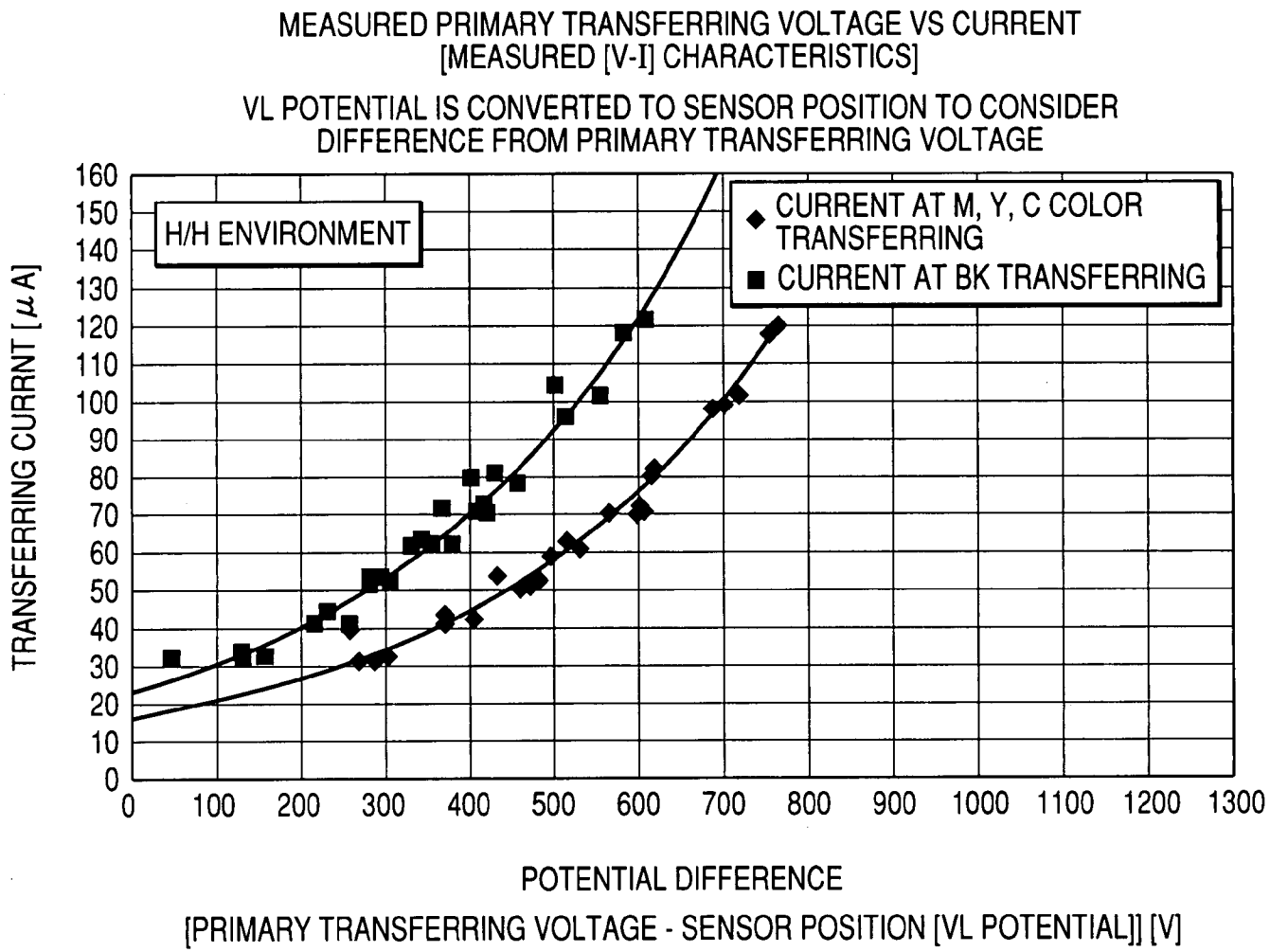
FIG. 13 shows the difference between primary transferring current-voltage characteristics in H/H environment based on the differences among developing means.
Figure 14:
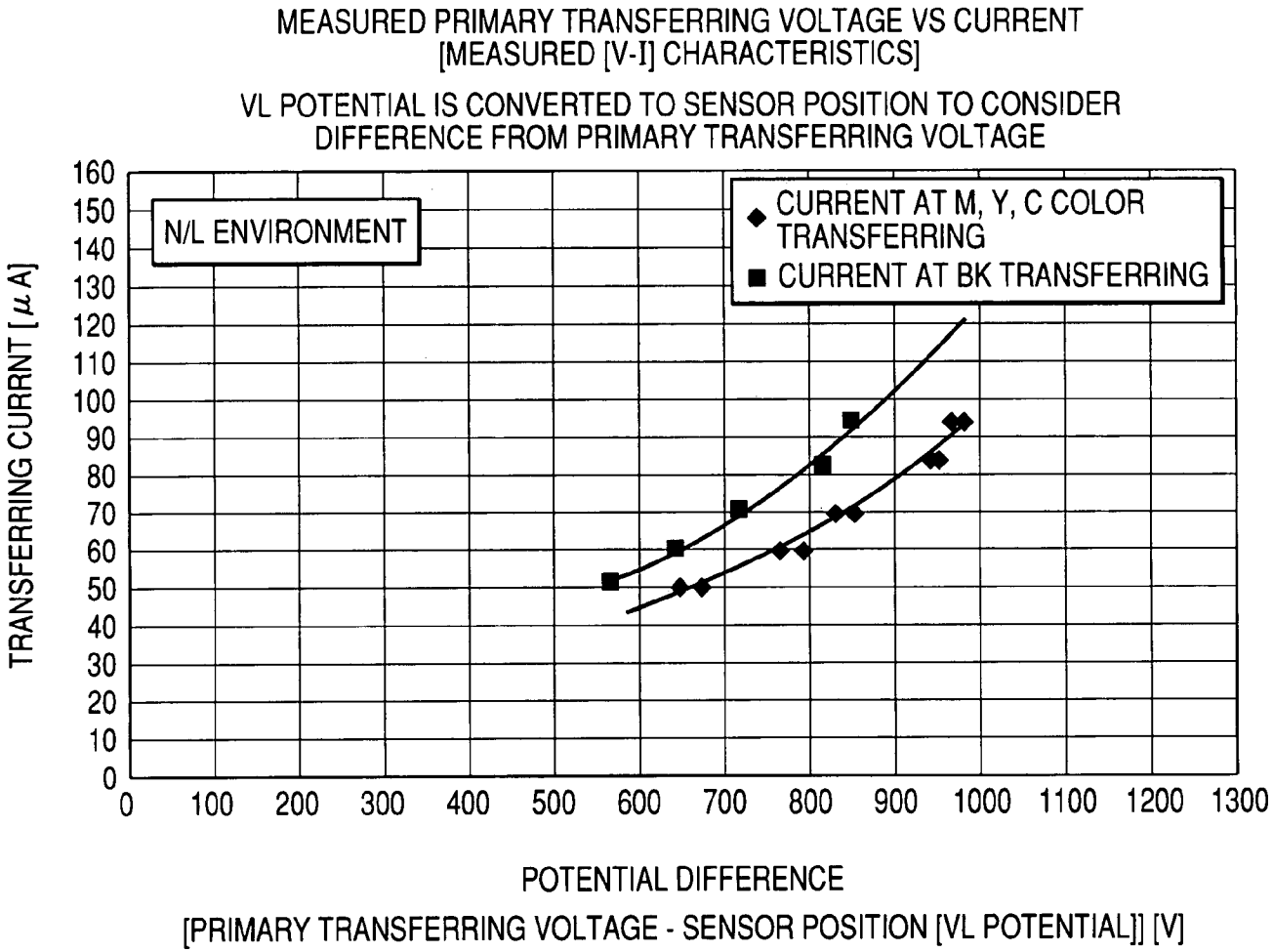
FIG. 14 shows the difference between primary transferring current-voltage characteristics in N/L environment based on the differences among the developing means.

FIGS. 13 and 14 show ΔV of the correction amount 1 obtained by subtracting the non-image portion potential difference from the applied transferring voltage as the axis of abscissas, and the result obtained by measuring the environmental difference in the current value flowing at that time at H/H (30° C./80%) and N/L (23° C./5%) as the axis of ordinates.

It is seen from FIGS. 13 and 14 that the current-voltage characteristics of the first developing means 7 and the second developing means 8 are greatly changed by the environment.

It is also seen that the voltage difference necessary to obtain the same transferring currents of the first developing means 7 and the second developing means 8 is also changed by the environment, and that the environmental difference by the types of the developing means is also changed.

Accordingly, in the image forming apparatus according to the present embodiment, the absolute amount of moisture is calculated on the basis of the detected information of the temperature and humidity of the environment sensor 30 so as to change over the target current of a proper primary transferring current, and is stored as TBL data by environment.

That is, the present embodiment is characterized in that in conformity with the fluctuation of the ambient environment, the target current value of the primary transferring voltage is changed at the VL adjustment section formed during potential control, whereby the correction amount 1 which is the difference potential between the aforementioned transferring voltage and the VL potential is renewed at any suitable time.

By the correction amount 1 being corrected at any suitable time in conformity with the fluctuation of the environment, the renewed value of the aforementioned correction amount 1 is added to a voltage value obtained from the result of the measurement of the current-voltage characteristic effected at the VL potential at the pre-rotation section during image forming described in the first embodiment, whereby the good transferability of the toner images to the intermediate transfer member can be obtained.

Third Embodiment

In describing a third embodiment, the construction of the image forming apparatus and the correction control construction for the primary voltage at the start of copying by image forming modes (B/W and F/C) are the same as those in the first embodiment and the second embodiment and therefore need not be described.

In the second embodiment, description has been made of the control construction in which when the operational environment of the image forming apparatus has changed, the absolute amount of moisture is calculated on the basis of the information (temperature and humidity) by the environment detecting sensor provided in the main body, not shown, to thereby follow the fluctuation of the environment.

However, it is generally known that even if the environment is under a constant condition, when a high voltage is supplied, for example, to a semi-electroconductive rubber or sponge roller having volume resistance of $10^5$–$10^8$ Ωcm as a primary transfer roller for a predetermined time, there occurs the fluctuation of the characteristic of the material in which the resistance value fluctuates.

It is also known that this phenomenon is related not only to the characteristic of the material but also to the electrically conducting prescription, and is changed by the difference in the manufacturing method for giving electrical conductivity such as ionic electrical conducting prescription or electronic electrical conducting prescription, and the characteristic of the environment, and a high voltage or a current level applied.

In a case where such a material fluctuated in resistance value, and particularly increased in resistance value, by the supply of electric power is used for the transfer roller and as in the present image forming apparatus, constant voltage control is effected, if the resistance value is too much increased, it will become impossible to obtain a target transferring current even under the upper limit value condition of a transferring voltage source and the transfer roller will be periodically interchanged as its life.

In a case where in such a condition that the supply of electric power is continuously effected as previously described, i.e., such a condition that image forming is continuously effected, there is reached a condition which deviates from a voltage condition for confining the current within the upper and lower limit values of the target transferring current, e.g. the current values of ±ΔI of the target value, it is necessary to periodically re-measure the basic target transferring voltage VT of the present invention and effect the supply of electric power by the use of transfer control.

In the image forming apparatus of the present invention, an image forming output controller portion, not shown, is provided with measuring means for counting the number N of output images, means for storing the measured number N of output images therein, and control means for resetting the value of the aforementioned number N of output images when the basic target voltage measurement control of the present invention and the control of finding the correction amount 1 are carried out.

As regards the number of images, for the mono-color like B/W, a sheet of output image is counted as one image, and in full-color image forming, the present image forming apparatus forms images by the use of four colors, i.e., Y, M, C and K, and therefore a sheet of output image is counted as four images.

By adopting such number of images, the time required to apply the primary transferring voltage can be measured as an equal condition irrespective of the B/W mono-color mode or the full-color mode.

The time for transferring one image differs depending also on the image forming size and therefore, in the present image forming apparatus, there is adopted, for example, a system whereby with one image of A4 size as the standard, A3 size is counted as two images.

For such counting means, it will suffice if the time required to apply the primary transferring voltage can be measured and therefore, the counting means need not be restricted to one for controlling the number of images, but can also be used as counting means for monitoring the number of fed sheets and whether B/W or F/C by the controller portion in the image forming apparatus without any relation to any control.

What is important is the fluctuation of the current caused under the same voltage application condition by the fluctuation amount of the resistance value and thus, it will suffice if in conformity with the characteristic of the transfer roller mounted in the image forming apparatus, the basic target voltage is measured periodically (at each predetermined number of images) and the timing for measuring the correction amount 1 is set. In the present image forming apparatus, it is carried out at the intervals of 250 images.

Further, this control frequency need not be at constant intervals, but by effecting such control that this control interval is automatically changed at any suitable time in conformity with the environment and the total electric power supply time, it becomes possible to control the transferring condition with better accuracy.

By empirically finding a control interval in advance in conformity with the resistance value fluctuation characteristic of the transfer roller to be mounted, the applied voltage level used, the environmental difference, etc., and setting a control interval conforming to the conditions of use, it becomes possible to always obtain good images suitably free of image inconveniences.

What is claimed is:

1. An image forming apparatus having:

charging means for charging an image bearing member;

latent image forming means for exposing said charged image bearing member to light, thereby forming an electrostatic latent image having an area of image portion potential and an area of non-image portion potential thereon;

developing means for applying a developing bias to a developer carrying member carrying a developer, thereby developing said electrostatic latent image on an opposite portion of said image bearing member, which is opposed to said developer carrying member, and forming a developer image on an area of said image portion potential;

transferring means for electrostatically transferring the developer image on said image bearing member to a transfer medium in a transferring portion, said transferring means having a transfer member capable of nipping said transfer medium between it and said image bearing member, and charge supplying means capable of supplying charges to said transfer member; and control means for detecting a voltage-current characteristic regarding said transfer member by applying a test bias to said transferring means which contacts said image bearing member during a non-transferring operation, and determining a transfer supplying condition to said transfer member during a transferring operation on the basis of a result of said detection, wherein said control means determines said transfer charge supplying condition on the basis of a first detection result obtained by performing said detection of applying said test bias to said transferring member which contacts an area of said non-image portion in said electrostatic latent image on said image bearing member which passes said opposite portion when said developing bias is not applied, and a second detection result obtained by performing said detection of applying said test bias to said transferring member which contacts an area of said non-image portion in said electrostatic latent image on said image bearing member which passes said opposite portion when said developing bias is applied.

2. An image forming apparatus according to claim 1, further comprising surface potential detecting means for detecting surface potential of said image bearing member, and wherein said control means determines said transfer charge supplying condition also by the use of a value of non-image portion potential detected by said surface potential detecting means.

3. An image forming apparatus according to claim 2, further comprising storing means for storing therein information regarding said first detection result detected at the preparing step of the image forming apparatus, said second detection result and the value of said non-image portion potential, and said control means determines said transfer charge supplying condition on the basis of said first detection result detected again during the non-transferring operation subsequent to the start of the image forming operation, and said information stored in said storing means.

4. An image forming apparatus according to claim 2, wherein said developing means comprises a plurality of developing means using developers of different colors, the non-image portion potential on said image bearing member is of a value corresponding to each of said plurality of developing means, said surface potential detecting means effects the detection of the non-image portion potential corresponding to each of said plurality of developing means at the preparing step of the image forming apparatus, said control means detects said first detection result at said preparing step in a state in which a developing bias is not applied to any one of said plurality of developing means, and detects said second detection result in a state in which the developing bias is applied to each of said plurality of developing means, and said control means determines said transfer charge supplying condition during the transferring operation for each color on the basis of the value of the non-image portion potential corresponding to each of said plurality of developing means, said first detection result, and said second detection result corresponding to each of said plurality of developing means.

5. An image forming apparatus according to claim 4, wherein said control means determines said transfer charge supplying condition also by the use of said first detection result detected again during the non-transferring operation subsequent to the start of the image forming operation.

6. An image forming apparatus according to claim 5, further having storing means for storing therein information regarding said first detection result detected at said preparing step, said second detection result and the value of said non-image portion potential, and wherein said control means determines said transfer charge supplying condition on the basis of said first detection result detected again during the non-transferring operation subsequent to the start of the image forming operation, and said information stored in said storing means.

7. An image forming apparatus according to claim 6, further comprising environment detecting means for detecting an environmental state in which the image forming apparatus is placed, and wherein said control means executes said preparing step again in conformity with a result of detection by said environment detecting means, and said storing means renews said information.

8. An image forming apparatus according to claim 1, wherein said non-image portion potential is light portion potential at which exposure by said latent image forming means has been effected, relative to dark portion potential of said image bearing member charged by said charging means, and said developing means effects developing on an area of said dark portion potential.

* * * * *

UNITED STATES PATENT AND TRADEMARK OFFICE

CERTIFICATE OF CORRECTION

PATENT NO. : 7,088,933 B2
APPLICATION NO. : 10/860156
DATED : August 8, 2006
INVENTOR(S) : Kenichiro Kitajima It is certified that error appears in the above-identified patent and that said Letters Patent is hereby corrected as shown below:

SHEET NO. 3 of 14:
Figure 4, "COMFIRMING" should read --CONFIRMING--.

SHEET NO. 4 of 14:
Figure 5, "AMONT" should read --AMOUNT--.

SHEET NO. 13 of 14:
Figure 13, "CURRNT" should read --CURRENT--.

SHEET NO. 14 of 14:
Figure 14, "CURRNT" should read --CURRENT--.

COLUMN 3:
Line 54, "carrying," should read --carrying--.

COLUMN 7:
Line 44, "charge ability" should read --chargeability--.

COLUMN 10:
Line 66, "the then" should read --then the--.

Signed and Sealed this

Thirteenth Day of March, 2007

JON W. DUDAS
*Director of the United States Patent and Trademark Office*